US005893822A

United States Patent [19]

Deni et al.

[11] Patent Number: 5,893,822

[45] Date of Patent: Apr. 13, 1999

[54] SYSTEM FOR VACUUM EVACUATION AND SEALING OF PLASTIC BAGS

[75] Inventors: Joseph A. Deni, East Amherst; Leonard A. Deni, E. Amherst, both of N.Y.

[73] Assignee: Keystone Mfg. Co., Inc., Buffalo, N.Y.

[21] Appl. No.: 08/955,810

[22] Filed: Oct. 22, 1997

[51] Int. Cl.[6] ..... B65B 31/00

[52] U.S. Cl. ..... 53/512; 493/256; 53/389.2; 53/389.3; 53/510

[58] Field of Search ..... 493/256; 426/410; 53/432, 433, 434, 510, 511, 512, 374.8, 374.9, 389.2, 389.3, 405, 408, 403

[56] References Cited

U.S. PATENT DOCUMENTS

| | | | |
|---|---|---|---|
| 4,179,862 | 12/1979 | Landolt | 53/512 |
| 4,506,600 | 3/1985 | Hersom et al. | 53/510 |
| 4,640,081 | 2/1987 | Kawaguchi et al. | 53/510 |
| 4,941,310 | 7/1990 | Kristen | 53/512 |
| 5,048,269 | 9/1991 | Deni | 53/512 |
| 5,239,808 | 8/1993 | Wells et al. | 53/374.8 |
| 5,338,166 | 8/1994 | Schultz | 53/510 |
| 5,698,250 | 12/1997 | DelDuca et al. | 53/432 |

*Primary Examiner*—James F. Coan
*Assistant Examiner*—Gene L. Kim
*Attorney, Agent, or Firm*—James J. Ralabate

[57] ABSTRACT

This invention involves a tapered vacuum bag sealer that can be used to seal conventional plastic bags and to vacuum canning jars or other food containers. The rear of the sealer housing has a connection for a PVC tube or other flexible tube that will extend to the jar or container being vacuumed to remove air therefrom. This rear connection avoids the necessity of the housing lid being opened before this vacuum procedure could be accomplished.

8 Claims, 8 Drawing Sheets

SYSTEM FOR VACUUM EVACUATION AND SEALING OF PLASTIC BAGS

This invention relates to a system for vacuum evacuation and subsequent sealing of plastic bags used in home and for light commercial use.

BACKGROUND OF THE INVENTION

It is known to use various heat sealing appliances to seal plastic bags generally used to contain foods for storage. Many of these appliances or devices simply use heat to fuse-close plastic bags. While there is a need for this type device, it is known that air left in the bag can seriously affect the perishable nature of the food contained therein. Thus, many of these devices evacuate air from the bags prior to sealing. It is desirable in many situations that items other than plastic bags need to be air evacuated such as mason jars, canning containers and the like. In applicant's commercially successful apparatus and method for sealing plastic bags, the vacuum sealer used has one and preferably three wires that are heated to varying degrees. In the preferred embodiment two wires are used or dedicated to sealing a plastic bag and one of the wires is used to cut the bag after the vacuum sealing step. The improved vacuum sealer is tapered downwardly, i.e. has a low profile to ensure a proper air flow during the vacuuming step. In the sealer used a turbine with curved fins is required to evacuate air from the bag. With the increase in air duct size and with the low profile of the unit, a more effective system is provided for evacuating air from the plastic bag to be used.

Most of the prior art devices while effective for evacuating air from plastic bags, they make no accommodations for air evacuation of mason jars or other containers. The use of the same appliance for vacuum sealing of plastic bags and for air evacuating canning containers would be highly desirable. It would therefore be highly desirable that a simple device be provided to accomplish this, especially for usage in the home for canning foods, etc.

Devices that evacuate air from bags are described in U.S. Pat. Nos. 4,179,862; 4,513,015; 4,660,355; 4,756,140; 4,756,422; 4,941,310 and 5,048,269.

In U.S. Pat. No. 4,179,862 (Landolt), a vacuum packing machine is disclosed having retracting means for pulling an extended open end of a bag into the vacuum chamber of the machine once the cover is closed. This retracting means comprises a spring-loaded rod fastened to the cover for pressing the end of the bag into a groove hollowed out in an edge of the packing machine housing. Landott's machine has a device for automatically pulling back the projecting open end of a product bag placed in the vacuum chamber. A groove is hollowed out in the edge of the vacuum chamber housing, and an elongated rod spring mounted to the underside of the cover penetrates into the groove when the cover is closed to thereby force the end of the bag projecting out of the machine into the groove. There is no accommodation in Landolt's device for vacuum connection to other food containers.

Clough, in U.S. Pat. No. 4,513,015, teaches the use of a method of sealing thermoplastic food containers. In Clough's method, a container holding food is sealed by an intermediate membrane made of a microporous plastic gas-breathable material. The gas is then extracted from the headspace through the membrane and afterwards the container is sealed by a final barrier membrane. Clough provides generally a process for sealing a thermoplastic based food container characterized in that after filing, the container is sealed by an intermediate membrane made of a microporous plastic gas-breathable material. Gas is then extracted from the headspace through the membrane and afterwards, as above noted, the container is sealed by a final barrier membrane.

In U.S. Pat. No. 4,600,355 (Kristen I), a system for using an adapter for extracting air from canning jars which are fitted with metal disc-type lids is disclosed. Kristen I discloses a bell-shaped adapter which facilitates the extraction of air from these canning jars fitted with metallic lids. The system operates in conjunction with a vacuum pump. The vacuum adapter is specially defined and claimed in Kristen I. Gannon, U.S. Pat. No. 4,756,140, discloses a process for packaging foodstuff where the food is enclosed in a thermoplastic bag. The bag is then placed in a container, one wall of which is made of deformable sheet material, preferably a sheet made of a silicone resin. The container is then connected to a source of vacuum and the pressure reduced in both the container and the bag. Heat is then applied to the deformable sheet to cause the surfaces to become sealed together. The invention also discloses the use of a preserving gas such as carbon dioxide after the bag is vacuumized.

Kristen II and III (U.S. Pat. Nos. 4,941,310 and 4,756,422, respectively) disclose an apparatus for vacuum sealing plastic bags by the use of a sealing apparatus having a single wire. In addition, Kristen II defines means in the apparatus for connection to a vacuum sealing attachment for containers other than plastic bags. Kristen II describes his system as follows: An apparatus for vacuum sealing plastic bags of the type disclosed in applicant's U.S. Pat. No. 4,756,422 comprises a hood adapted to define a vacuum chamber when it is moved to a closed position on a support surface. An elastomeric seal, circumventing the vacuum chamber, is adapted to engage and statically seal outer surfaces of a bag. A vacuum system and sealer are provided for evacuating and heat sealing the bag. The hood can be pivotally mounted on a base or can be used as separate, self-contained unit adapted for placement on a support surface defined on a counter top or the like. The apparatus is further adapted for connection to a unique vacuum sealing attachment for a container whereby the container can be selectively evacuated. Kristen II provides a vacuum chamber or trough (34) which extends through the frontal side of the apparatus. An opening 86 is in communication with trough 34 and is adapted to be used with or connected to a flexible plastic tube that connects the opening 86 with a container to be air evacuated. The vacuum means of the apparatus thus can be used to evacuate air from containers (78) in addition to its use to evacuate air from plastic bags.

In U.S. Pat. No. 5,048,269 (Deni), a vacuum sealing apparatus is disclosed which is designed for easy air flow for evacuating air from bags. This device contains at least three wires dedicated to both heat cutting plastic bags and heat sealing plastic bags. In a vacuum sealer having a low profile which facilitates better air flow from sealer to bag is disclosed in a three-wire unit embodiment of this invention, the center wire has a dedicated cutting function while the two outside wires have dedicated sealing functions. The sealing wire closest to the bag roll seals the plastic roll to form a subsequent bag for use. The sealing wire farthest from the plastic roll seals the immediate bag. Also the use of expensive cutting mechanisms is avoided. While more than three heated wires may be used if desired, it has been found that three wires provide the most efficient cost considered embodiment. A turbine fan having curved fins is used to improve the vacuuming effect of the unit. It has been considered that the vacuuming effect is enhanced at least 50% by the use of curved fins rather than the prior art straight fins. There is no accommodation in this device for connection to external containers for evacuating air from these external containers.

There is a need for a household vacuum sealer that is easy to use with commercially available plastic bags and having sealing means in some preferred embodiments with a plurality of sealing wires. In addition, this sealer should contain convenient means for air evacuation of not only plastic bags, but also containers such as Mason or Ball jars used for canning foods. Conveniently placed controls and conveniently located jar air evacuation connection means would enhance the commercially acceptable usage of such a device.

SUMMARY OF THE INVENTION

It is therefore an object of this invention to provide a vacuum sealer devoid of the above-noted disadvantages.

Another object of this invention is to provide a vacuum sealer having a convenient vacuum outlet means to evacuate air from remote containers.

Still a further object of this invention is to provide a simple to use, effective and relatively inexpensive vacuum sealer that can be used to evacuate air from plastic bags and/or other detached containers.

A further object of this invention is to provide a vacuum sealer with easy-to-use connection means for vacuum communication with other containers.

A yet further object of this invention is to provide a vacuum sealer that in one embodiment has a plurality of wires that can be heated to varying degrees.

Another still further object of this invention is to provide a vacuum sealer that in one embodiment is tapered downwardly for a better air flow during the vacuuming step or steps.

Still yet a further object of this invention is to provide a dual function vacuum sealer. One function is to vacuum evacuate plastic bags inserted into the front of said sealer and the second function is to vacuum evacuate containers using a tubular means connected from said sealer to said container.

The se and other objects of this invention are accomplished by a tapered vacuum sealer having improved air flow properties and is adapted for vacuum sealing conventional plastic bags or to vacuum sealer other obscure containers such as canning jars and the like. When the vacuum sealer is to be used with remote containers, a plastic-flexible PVC tube is connected to the rear section of the sealer and extended to connect with the remote container. By "remote" is meant the container itself is not in contact with the sealer but rather is connected to the sealer by a flexible tube. It is critical to this invention that the tube connection means in the sealer be located in the rear lower (not lid) section of the sealer. This is important since the lid can be opened and the remote vacuum system would continue to work in spite of the open lid. In other vacuum sealers, the remote vacuum operation will not function if the lid is only slightly ajar. As noted earlier, the lid of the apparatus of this invention provides a simple-to-use turn valve located on the back of the unit that connects the use of the apparatus to either a bag vacuum sealer or to a vacuum means to air evacuate a mason jar or the like. The use of the unit as a vacuum means for canning jars is not dependent upon the lid being fully closed, it can be used for that matter if the lid is fully opened. The controls being located in the back of the sealer unit provides a very convenient method for transferring usage from a bag sealer to a jar vacuum means. It is easy to switch back and forth from one usage to the other merely by turning the turn valve located in the rear of the unit usably independent of any other machine component such as the lid.

The lid can be opened or shut depending upon the specific needs of the user when he is using the device in the remote mode. It is preferred that the vacuum sealer of this invention have three wires, two of which are used or dedicated to sealing a plastic bag and one of the wires is used to cut the bag after the vacuum sealing step. However, the vacuum sealer of this invention can have one, two or three or more wires depending upon the usage. The vacuum sealer of this invention is tapered downwardly having a low profile for better air flow during the bag sealing and vacuum step. This low profile, however, has no significance when the sealer is used in the remote mode. When used in the bag sealing mode, the nozzle is located in the middle of the housing unit; the nozzle is placed in the bag to extract air. An important feature in the sealer of this invention is that there is provided a turn valve located on the back lower portion of the unit which when turned aligns with an opening extending to a conduit in the interior of the sealer housing. This conduit extends to a pump which provides the vacuum action required to extract air from a container. When the turn valve is closed, i.e. not aligned with the opening, the sealer or unit is then operated in the bag sealing mode.

DETAILED DESCRIPTION OF THE DRAWING AND PREFERRED EMBODIMENTS

Figure 1:
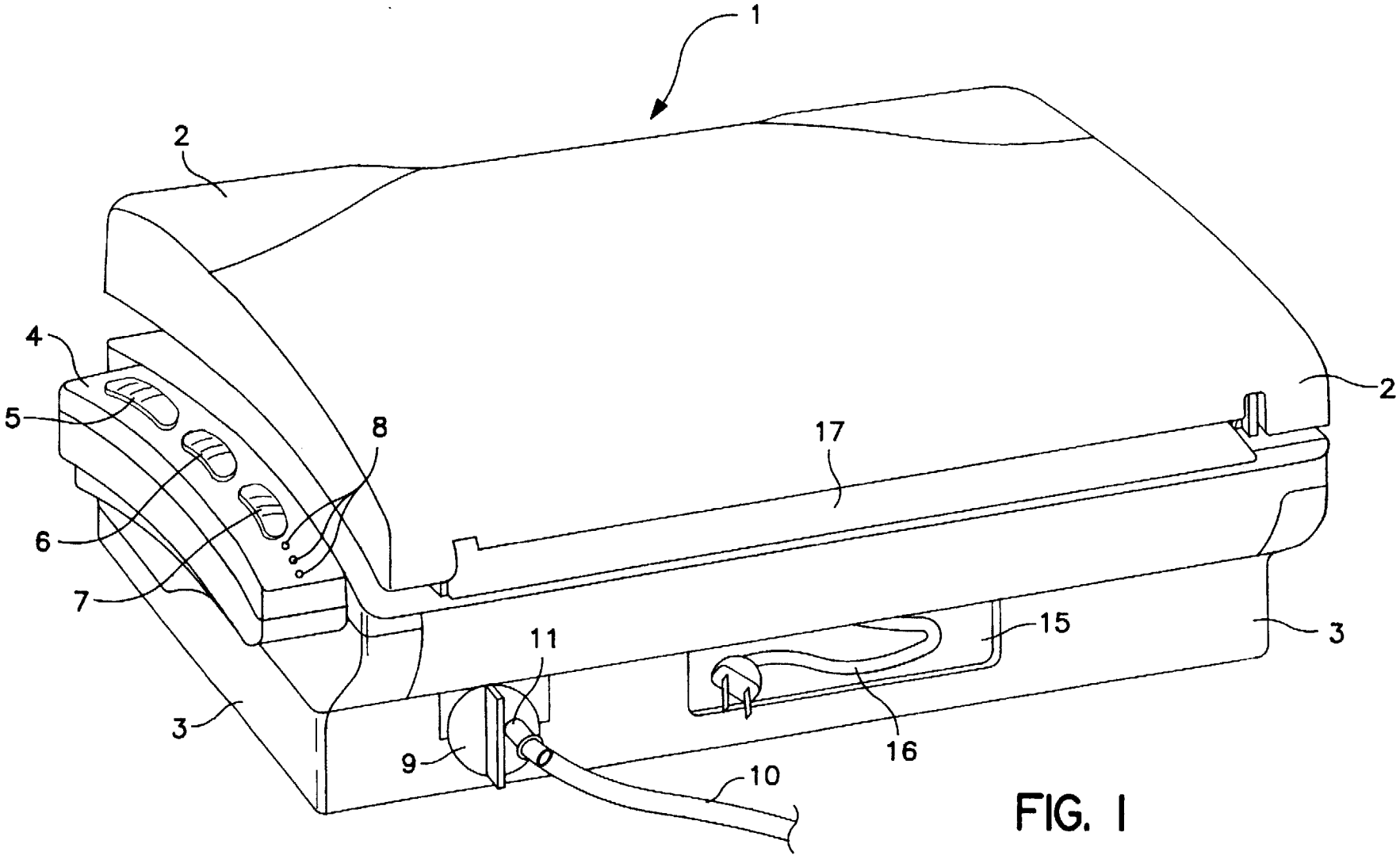
FIG. 1 is a rear side perspective view of the vacuum sealer of this invention with the lid closed.
Figure 2:
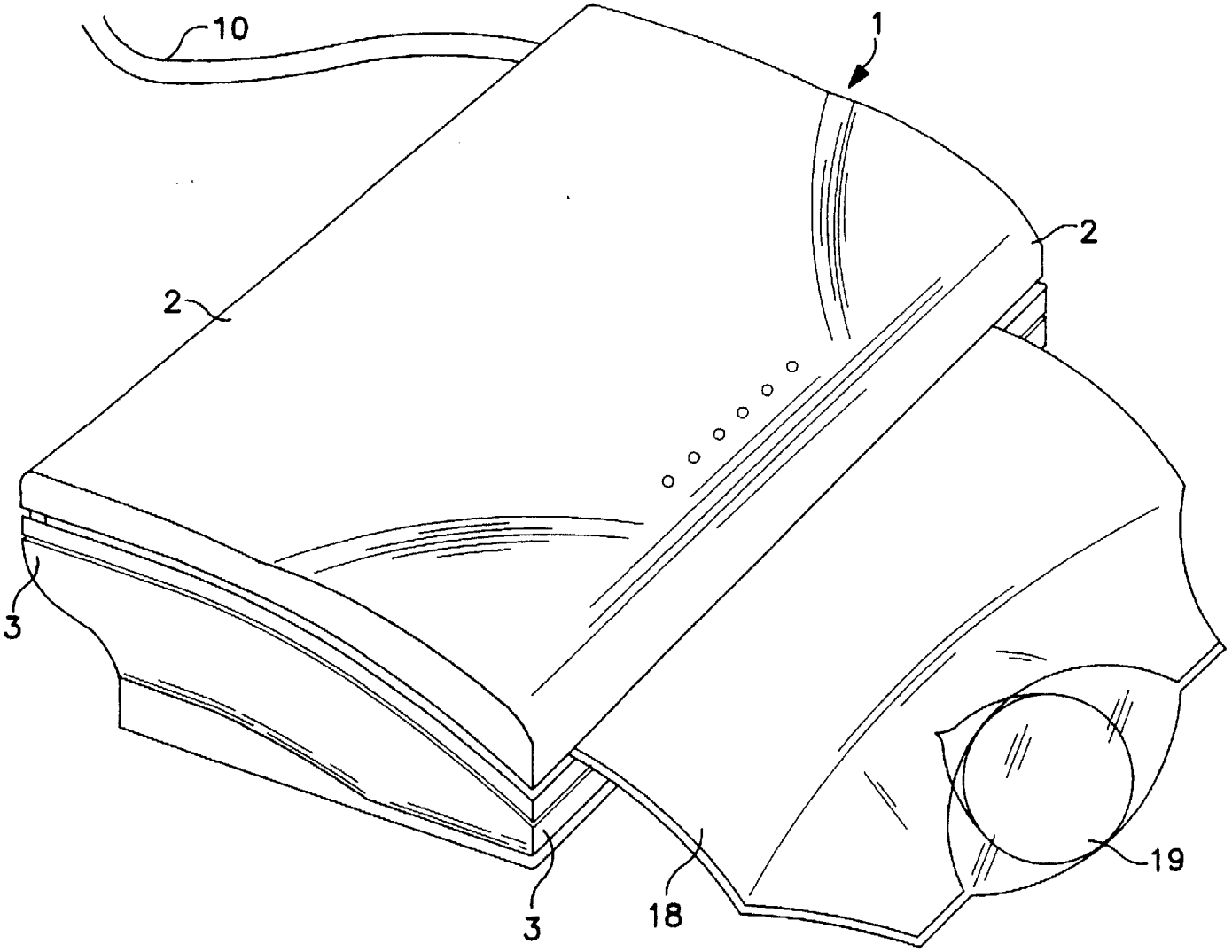
FIG. 2 is a front side perspective view of the vacuum sealer of this invention when used in the bag mode.
Figure 3:
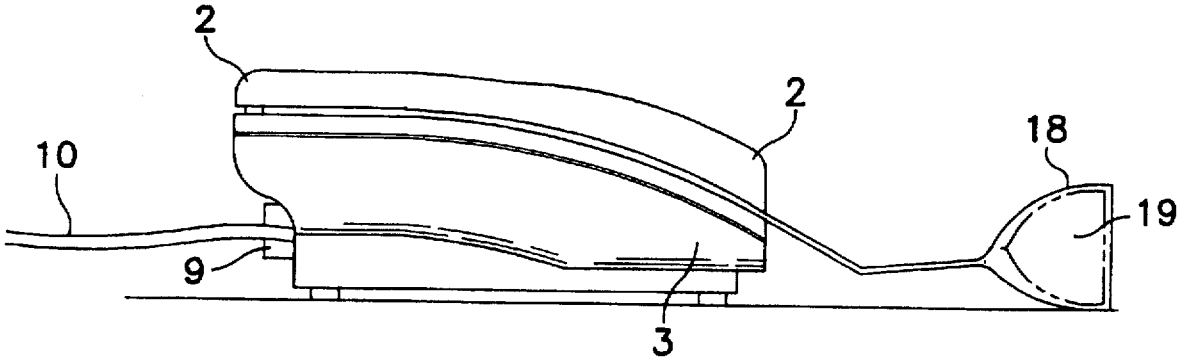
FIG. 3 is a side plan view of the vacuum sealer of this invention when used in the bag mode.
Figure 6:
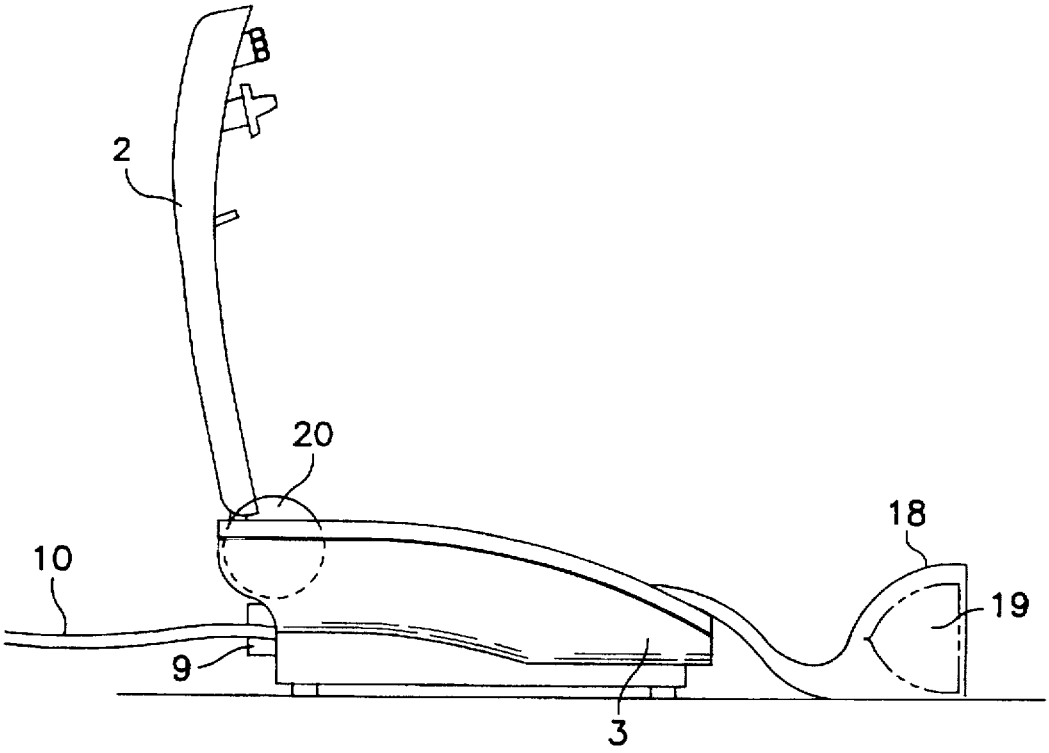
FIG. 6 is a side plan view of the sealer of this invention with the lid open.

In FIG. 1 the vacuum sealer 1 of this invention comprises an upper lid housing or section 2 and a bottom housing or section 3. On the side of vacuum sealer 1 is a control panel 4 having operation buttons 5, 6 and 7 which are used to control the operation of the sealer 1. Button or switch 5 is used when a bag is to be both sealed and cut, button 6 is used when the bag is to be only sealed or only cut; and button 7 is used to indicate the type of bag to be selected when unit 1 is to be used to evacuate a mason jar, the vacuum only button 6 is pressed. On the lower or bottom housing 3 is located a turn valve 9 which controls the use of sealer 1 as functioning in the bag mode or in the remote mode. As earlier discussed, the "bag mode" is the use of sealer 1 to seal plastic bags as shown in FIGS. 2, 3 and 6. The "remote mode" is when the sealer is used with a flexible or other tube 10 connected to a container not in direct contact with sealer 1. Turn valve 9 is rotated until its valve aperture 11 aligns with an opening or vacuum outlet means 12 to the interior of lower housing 3. Once aligned, a conduit 13 and 14 in the interior of the lower housing connects with a pump 15 which provides the vacuum action; see FIG. 7. Notice that lid 2 may be either opened or closed and still the sealer 1 will function in the remote mode. This is accomplished by placing the remote mode operation means or turn valve 9 in the rear bottom of sealer 1.

Also in the rear bottom section or housing is located a cord compartment 15 for storing the electric cord 16 when sealer 1 is not in use. Lid portion 2 is connected to lower housing 3 by a movable lid hinge portion 17 which permits the lid 2 to be opened or closed.

In FIG. 2 the sealer 1 of this invention is illustrated when used in the bag mode, i.e. evacuating and sealing of bag 18. A food item 19 or other goods are placed into bag 18 and by pressing down on lid 2, the bag 18 is evacuated, sealed and cut; for specifics see the disclosure of U.S. Pat. No. 5,048,269, which is incorporated herein by reference.

FIG. 3, a side view, illustrates use of sealer 1 also in the bag mode; note the tapered profile of sealer 1 for better air flow and more efficient air evacuation from the bag 18.

Figure 4:
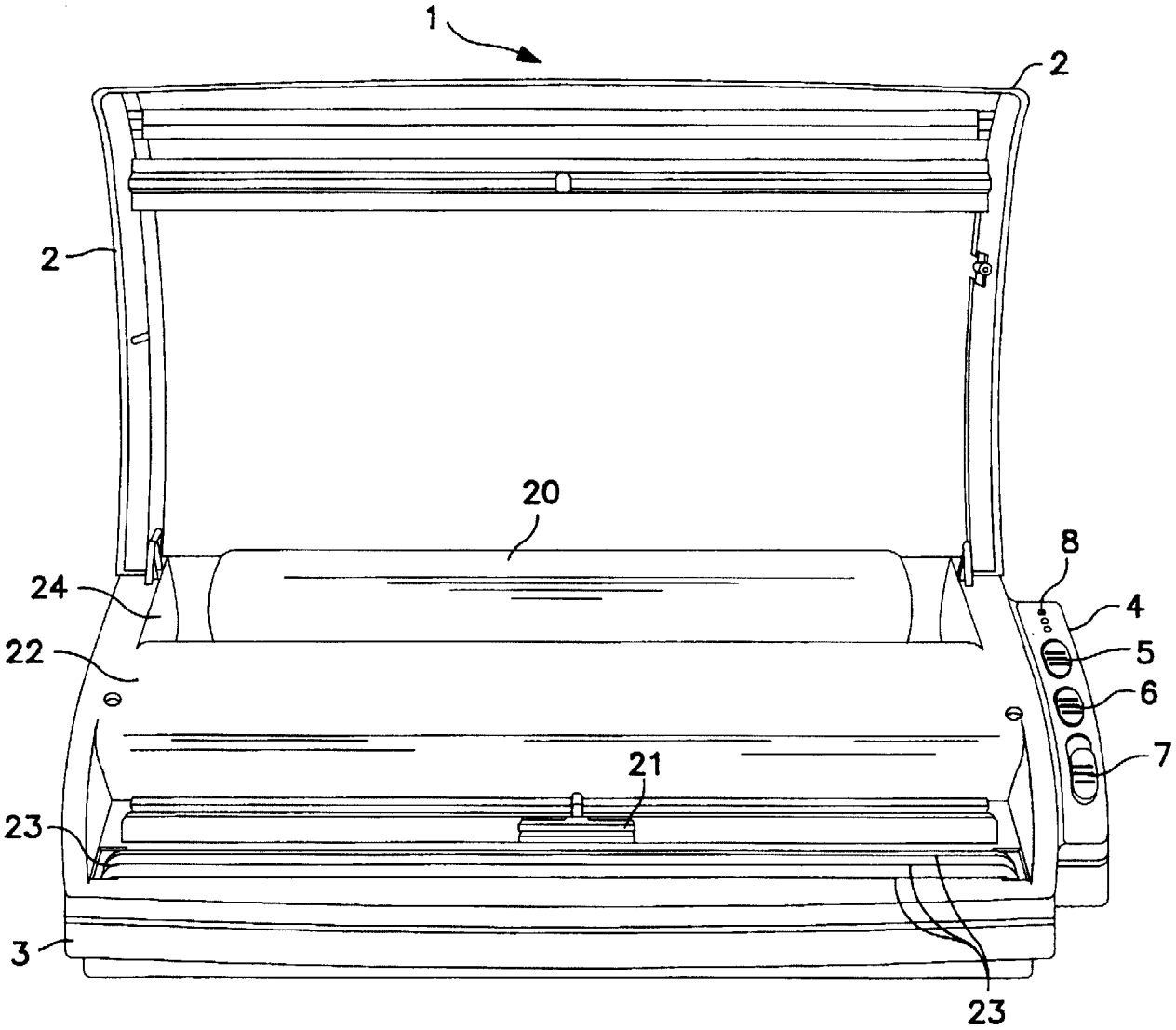
FIG. 4 is a front plan view of the sealer of this invention when the lid is opened.

FIG. 4 illustrates sealer 1 in an open view where lid 2 is opened illustrating the plastic bag roll 20 and air extraction nozzle 21. Also shown is the rounded bag guide 22 which is important since it holds bag 18 flat and in place during the cutting step and subsequent operation of sealer 1. Electric wires 23 including only one wire may be used. It is also important to this invention that guide 22 be located between bag roll compartment 24 and nozzle 21. The control panel 4 shown is one embodiment of a panel; any suitable control panel 4 may be used.

Figure 5:
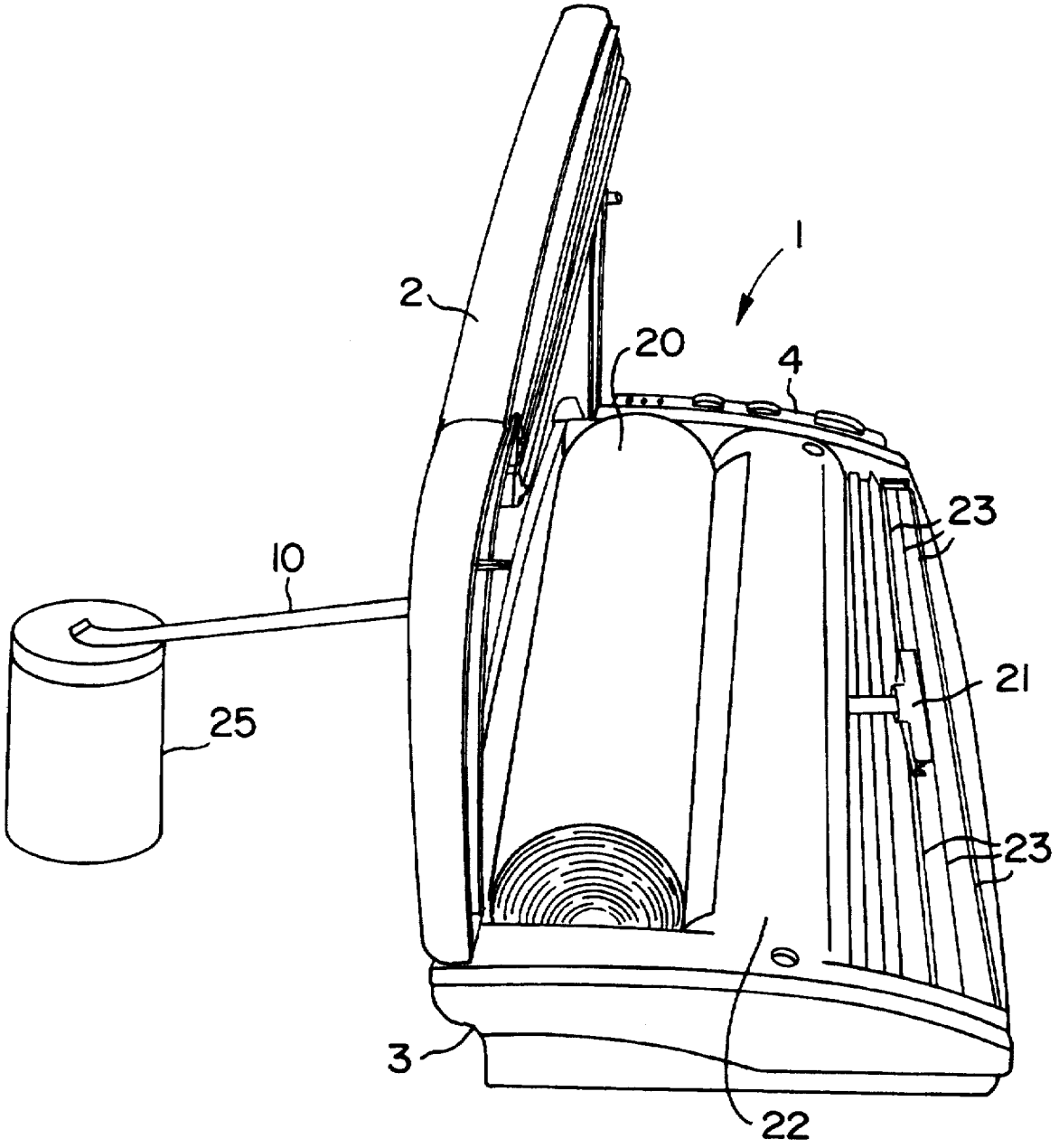
FIG. 5 is a top side perspective view of the vacuum sealer with the lid open.

In FIG. 5 the sealer 1 is opened, lid 2 raised while tube 10 is connected to a canning jar 25 for evacuation of air from jar 25. Note that flexible tube 10 is connected to the rear portion of the lower housing 3, and the sealer 1 can be used when lid 2 is in the open position. The bag roll 20 is located in a bag depression and is formed immediately behind curved or rounded bag guide 22. Bag supply housing or compartment is tubular in order to accommodate a roll of plastic bags. The bag supply then extends over guide 22 for a smooth path unobstructed by any sharp corners or edges. Once the lid 2 is closed, the bag sealing operation is initiated.

Figure 6A:
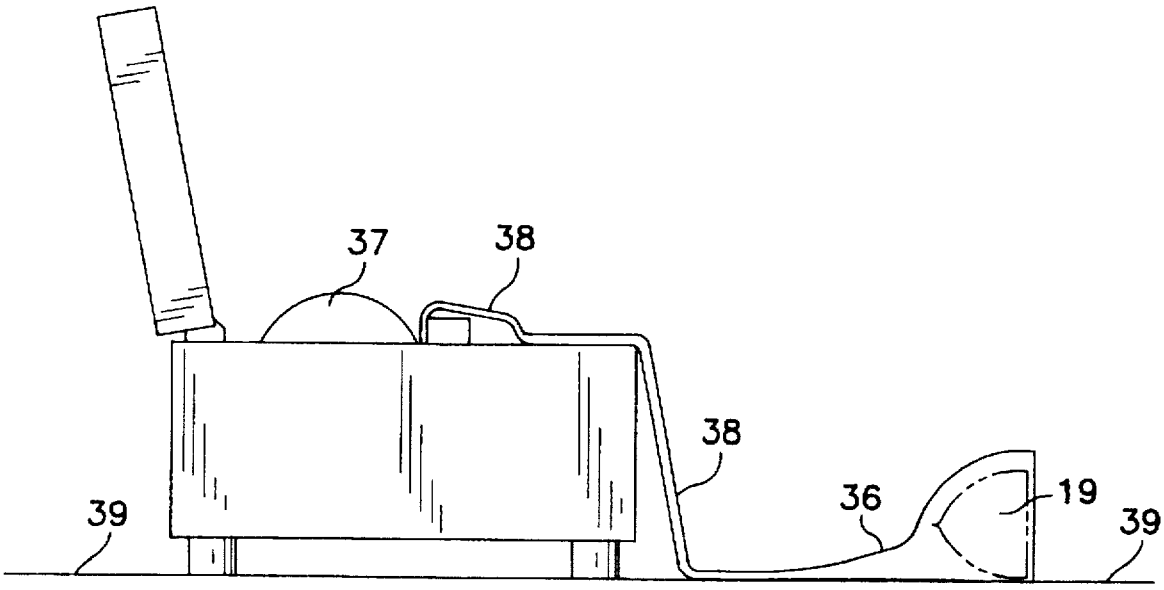
FIG. 6A PRIOR ART
FIG. 6A is a side plan view of a prior art sealer with the lid open.

FIG. 6 is a side view of sealer 1 showing how easily sealer 1 functions in the remote mode even when lid 2 is raised. FIG. 6A shows the higher and squarer construction of prior art sealers where the air flow through bag 36 is impeded by folds, etc. Roll 37 and lead edge 38 also do not provide a straight air flow channel even when on a flat support 39.

Figure 7:
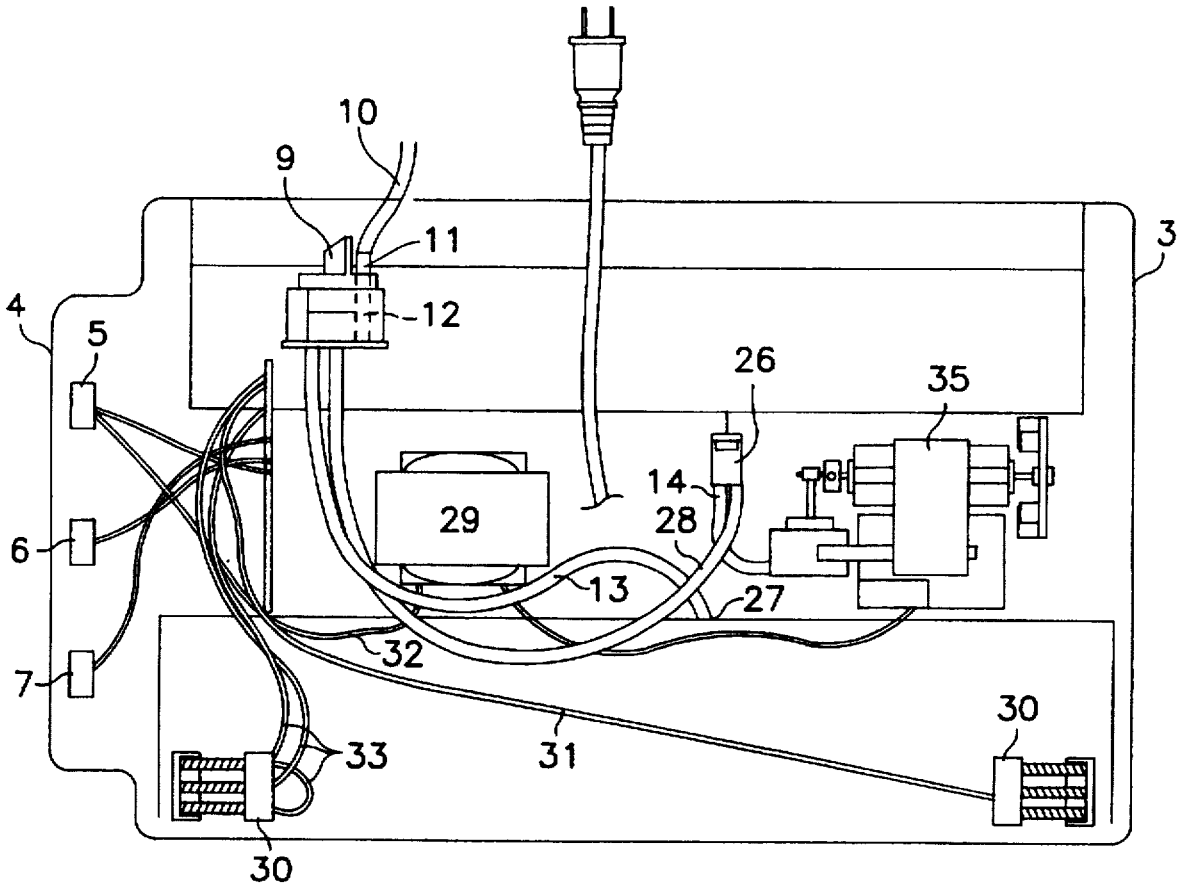
FIG. 7 is a bottom plan view of the interior portion of the sealer with the bottom housing removed and detached from the upper lid portion.

In FIG. 7 the interior of lower housing 3 is shown. Flexible tube 10 is connected to valve aperture 11, which is in alignment with entrance or opening 12, which connects to tube 13 and ultimately 14 for air flow connection to pump 35. Pump 35 provides the means to cause a vacuum evacuation of air from either and both a bag 18 or a remote jar or container 25. An air relay 26 may or may not be used as desired. Any conventional pump 35 may be used such as Model No. AS878B provided by provided by Kwonnie Electrical Products Limited of 1001B Sunbeam Center, 27 Shing Yip Street, Kwun Tong, Kowloon, Hong Kong. When opening 12 is closed then the vacuuming action of the pump is transferred to vacuum transfer station 27 which in turn provides vacuum action to nozzle 21 via nozzle conduit connection tube 28. Transformer 29 provides or transfers the electrical energy from electric source cord 16 to electric wires via wire connections 30. Transformer 29 also transfers electrical energy to circuit board 31 which in turn provides the necessary electrical energy to the control panel 4. Various electrical wires 31, 32, and 33 connect the components of FIG. 7.

Figure 8:
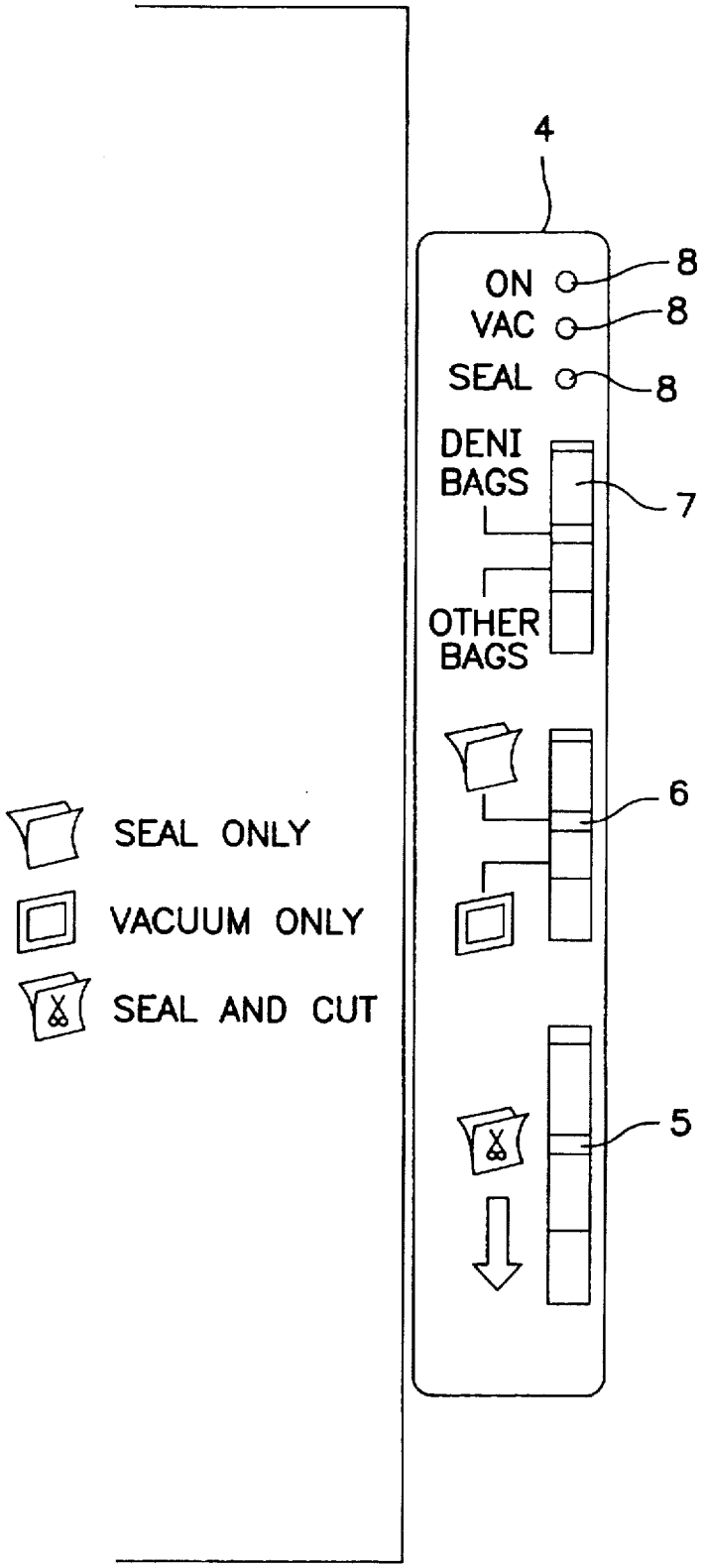
FIG. 8 is a preferred structure in one embodiment for the operation panel used on the side portion of the sealer of this invention.

In FIG. 8, the elements of control panel 4 in one embodiment are illustrated. This FIG. 8 embodiment is different than the control panel shown in FIG. 4. However, any suitable panel may be used. The lights 8 from top to bottom indicate top-red-unit is on, center light green-seal is occurring, bottom light-yellow-vacuum is in operation in either bag mode or remote mode. Button 7 has two settings, one for applicant's bag usage and a second setting for the use of other bags. Button 6 can be set for vacuum only of a bag or sealing only of a bag. Button 5 is for cutting and sealing of a bag 18. The set up of components on panel 4 may be varied depending upon desired usage, the present configuration is for illustration purposes only, since many different arrangements on panel 4 may be used.

The preferred and optimumly preferred embodiments of the present invention have been described herein and shown in the accompanying drawing to illustrate the underlying principles of the invention, but it is to be understood that numerous modifications and ramifications may be made without departing from the spirit and scope of this invention.

What is claimed is:

1. A vacuum sealer comprising in combination an upper lid section, a lower housing vacuum generating means to provide and generate a vacuum, means for cutting and sealing a plastic bag and means for providing a vacuum action to a remote container, said means for cutting and sealing a plastic bag comprising up to three wires located along a sealer entrance and positioned in said lower housing, wherein at least one wire is used to cut and at least the same one wire or a second wire is used to seal a plastic bag, said means for providing a vacuum action to a remote container comprising a vacuum aperture outlet means located in a rear section of said lower housing, said vacuum aperture outlet means for providing a vacuum action to a remote container wherein said vacuum aperture outlet means extends from an interior of said lower housing to the atmosphere.

2. The sealer of claim 1 wherein said means for providing a vacuum action to a remote container comprising a flexible tube in airtight connection to said aperture, said flexible tube having means for connection to a remote container.

3. The sealer of claim 1 wherein said upper lid housing together with said lower housing has a tapered profile to facilitate unobstructed air flow from said vacuum generating means to a container to be air evacuated.

4. The sealer of claim 1 wherein said vacuum aperture outlet means is connected to an air pump located in said lower housing.

5. The sealer of claim 1 wherein said vacuum generating means comprises an air pump connected to said vacuum aperture outlet means, both said air pump and said vacuum aperture outlet means located in said lower housing.

6. The sealer of claim 1 wherein said means for cutting and sealing a plastic bag comprises three substantially parallel conductive wires, two of said wires dedicated to forming an airtight seal on said plastic bag and one of said wires dedicated to forming a tear line on said bag.

7. The sealer of claim 1 wherein said means to provide a vacuum action to a remote container can be operated with said upper lid housing in an open or closed position.

8. An apparatus for vacuum evacuating a plastic bag and a remote container, said apparatus comprising an upper lid section, a lower housing, vacuum generating means to provide and generate a vacuum, means for cutting and sealing a plastic bag and means for providing a vacuum action to a remote container, said means for cutting and sealing a plastic bag comprising at least three wire means or wires located along a sealer entrance provided by the separation of said upper lid section and said lower housing, said wire means for cutting and sealing located in the front portion of said lower housing, at least one of said wires has means to cut said plastic bag and at least one of said wires has means to seal said plastic bag, said means for providing a vacuum action to a remote container comprising a turn valve over an aperture outlet means located in a rear section of said lower housing.

* * * * *